US007862357B2

(12) United States Patent
Tufano et al.

(10) Patent No.: US 7,862,357 B2
(45) Date of Patent: Jan. 4, 2011

(54) FLUORESCENT LAMPHOLDER

(75) Inventors: Anthony Tufano, N. Massapequa, NY (US); David B. Balaban, Hauppauge, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 12/568,369

(22) Filed: Sep. 28, 2009

(65) Prior Publication Data

US 2010/0015832 A1 Jan. 21, 2010

Related U.S. Application Data

(63) Continuation of application No. 11/520,114, filed on Sep. 12, 2006, now Pat. No. 7,597,575.

(60) Provisional application No. 60/717,081, filed on Sep. 13, 2005.

(51) Int. Cl.
*H01R 33/08* (2006.01)
*H01R 33/02* (2006.01)

(52) U.S. Cl. ..... 439/239; 439/241

(58) Field of Classification Search ..... 439/239, 439/226, 227, 229, 233, 236, 240–244
See application file for complete search history.

(56) References Cited

U.S. PATENT DOCUMENTS

| | | | |
|---|---|---|---|
| 2,163,902 | A | 6/1939 | Wertzhelser |
| 2,247,117 | A | 6/1941 | De Reamer |
| 2,284,376 | A | 5/1942 | De Reamer et al. |
| 2,848,705 | A | 8/1958 | Williams et al. |
| 3,005,175 | A | 10/1961 | Pistey |
| 3,060,399 | A | 10/1962 | Pistey |
| 3,176,260 | A | 3/1965 | Pascucci |
| 3,297,977 | A | 1/1967 | Smith |
| 3,328,577 | A | 6/1967 | Vermeulen et al. |
| 3,363,094 | A | 1/1968 | McLaughlin |
| 3,384,858 | A | 5/1968 | Johnson |
| 3,397,376 | A | 8/1968 | Gombar |
| 3,401,242 | A | 9/1968 | McLaughlin |
| 3,524,053 | A | 8/1970 | Johnson |

(Continued)

FOREIGN PATENT DOCUMENTS

| | | |
|---|---|---|
| EP | 0 621 661 A2 | 3/1998 |

(Continued)

OTHER PUBLICATIONS

Leviton OEM-100 Catalog, Leviton Manufacturing Co., Inc., 51 pgs. (2005).

(Continued)

*Primary Examiner*—Javaid Nasri
(74) *Attorney, Agent, or Firm*—Carter, DeLuca, Farrell & Schmidt, LLP

(57) ABSTRACT

A fluorescent lampholder with a top portion for supporting a fluorescent lamp and a base portion with a wire opening located on the bottom surface of the base that receives wires without exposing the wires to the exterior surface of a fixture. The lampholder is capable of supporting various types and/or sizes of fluorescent lamps such as "tall", "medium" and "small" T-8 fluorescent lamps as well as other types and/or sizes of fluorescent lamps.

31 Claims, 15 Drawing Sheets

U.S. PATENT DOCUMENTS 3,568,132 A 3/1971 Johnson
3,631,376 A 12/1971 Halfaker
3,639,887 A 2/1972 Johnson et al.
3,651,445 A 3/1972 Francis
3,654,587 A 4/1972 Mews et al.
3,681,593 A 8/1972 Genovese et al.
3,681,594 A 8/1972 Johnson
3,685,003 A 8/1972 Watt
3,686,618 A 8/1972 Gales
3,752,977 A 8/1973 Davis
3,771,106 A 11/1973 Matsumoto et al.
3,828,299 A 8/1974 Johnson et al.
3,836,814 A 9/1974 Rodriquez
3,851,295 A 11/1974 Geier
3,975,073 A 8/1976 McLaughlin
4,084,873 A 4/1978 Grate
4,101,956 A 7/1978 Crane
4,102,558 A 7/1978 Krachman
4,198,108 A 4/1980 Bassetto
4,198,109 A 4/1980 Ustin
4,280,169 A 7/1981 Allen
4,298,918 A 11/1981 Metcalf, II
4,306,758 A 12/1981 Johnson et al.
4,347,460 A 8/1982 Latassa et al.
4,414,489 A 11/1983 Young
4,495,443 A 1/1985 Cummings
4,542,947 A 9/1985 Flor et al.
4,565,415 A 1/1986 Feinberg
4,570,105 A 2/1986 Engel
4,617,519 A 10/1986 Rosenthal
4,623,823 A 11/1986 Engel
4,637,671 A 1/1987 Johnson et al.
4,643,503 A 2/1987 Johnson et al.
4,645,283 A 2/1987 MacDonald et al.
4,660,906 A 4/1987 Haraden
4,683,402 A 7/1987 Aubrey
4,688,874 A 8/1987 Bjorkman
4,723,200 A 2/1988 Troen
4,744,767 A 5/1988 Henrici et al.
4,746,840 A 5/1988 Lim
4,754,197 A 6/1988 Zwald
D297,322 S 8/1988 Johnson et al.
D297,529 S 9/1988 Johnson et al.
4,772,216 A 9/1988 Szymanek
4,804,343 A 2/1989 Reedy
4,863,394 A 9/1989 Henshaw, Jr.
D304,716 S 11/1989 Johnson et al.
4,936,789 A 6/1990 Ugalde
4,939,420 A 7/1990 Lim
5,006,970 A 4/1991 Mackiewicz
5,015,917 A 5/1991 Nigg
5,044,974 A 9/1991 Pelton et al.
5,122,074 A 6/1992 Maag et al.
5,135,407 A 8/1992 Berends
5,150,008 A 9/1992 Lee
5,169,331 A 12/1992 Caldwell et al.
5,189,339 A 2/1993 Peshak
5,202,607 A 4/1993 Broyer et al.
5,261,831 A 11/1993 Vendal et al.
5,282,755 A 2/1994 Ahlstone
5,320,547 A 6/1994 Mews et al.
5,320,548 A 6/1994 Schadhauser
5,390,096 A 2/1995 DeKleine et al.
5,596,247 A 1/1997 Martich et al.
5,616,042 A 4/1997 Raby et al.
5,634,820 A 6/1997 Vakil
5,636,919 A 6/1997 Walker
5,653,527 A 8/1997 Muessli
5,688,139 A 11/1997 Gust et al.
5,727,869 A 3/1998 Crosby et al.
5,743,626 A 4/1998 Walker
5,746,615 A 5/1998 Ichikawa et al.
5,758,952 A 6/1998 Getselis et al.
5,759,054 A 6/1998 Spadafore
5,816,837 A 10/1998 Henrici et al.
5,855,487 A 1/1999 Kunishi
D406,814 S 3/1999 Henrici
5,931,691 A 8/1999 Mews et al.
5,971,564 A 10/1999 Wang
D417,653 S 12/1999 Henrici
6,027,230 A 2/2000 Huber et al.
6,039,597 A 3/2000 Getselis et al.
6,048,220 A 4/2000 Eddington et al.
6,082,873 A 7/2000 Schmidt
6,124,673 A 9/2000 Bishop
6,159,029 A 12/2000 Burwell
6,290,522 B1 9/2001 Campolo et al.
6,340,310 B2 1/2002 Henrici et al.
6,364,679 B1 4/2002 Gerstberger
6,561,828 B2 5/2003 Henrici et al.
6,565,230 B2 5/2003 Ashley
6,570,306 B2 5/2003 Henrici et al.
6,582,253 B1 6/2003 Lau
6,632,100 B1 10/2003 Richardson
6,641,419 B1 11/2003 Richardson
D491,890 S 6/2004 Henrici et al.
D493,425 S 7/2004 Henrici et al.
6,869,298 B2 3/2005 Latsis
6,884,103 B1 4/2005 Kovacs
7,090,390 B2 8/2006 Pazula
7,097,327 B1 8/2006 Barton
7,125,159 B2 10/2006 Hirsch et al.
7,153,151 B2 12/2006 Lingemann et al.
7,247,040 B2 7/2007 Lingemann et al.
D550,884 S 9/2007 Tufano et al.
7,291,029 B2 11/2007 Hale et al.
7,322,722 B2 1/2008 Hartmann et al.
D564,129 S 3/2008 Tufano et al.
7,338,302 B2 3/2008 Thiele et al.
7,339,790 B2 3/2008 Baker et al.
D577,854 S 9/2008 Tufano et al.
7,448,892 B2 11/2008 Dowdle et al.
2003/0068913 A1 4/2003 Henrici et al.
2003/0100210 A1 5/2003 Lewis
2005/0026483 A1 2/2005 Latsis
2005/0104524 A1 5/2005 Bishop
2005/0148242 A1 7/2005 Latsis
2005/0202704 A1 9/2005 Lingemann et al.
2006/0170323 A1 8/2006 Hirsch et al.
2006/0273730 A1 12/2006 Chang
2007/0066112 A1 3/2007 Tufano et al.
2007/0077801 A1 4/2007 Lingemann et al.
2007/0117466 A1 5/2007 Thiele et al.
2007/0183160 A1 8/2007 Tufano et al.

FOREIGN PATENT DOCUMENTS

EP 0 621 661 A3 3/1998
EP 0 834 967 A2 4/1998
EP 0 834 967 B1 4/1998
EP 1562269 A1 8/2005
JP 61-103887 5/1986
JP 62-104384 3/1987

OTHER PUBLICATIONS

PCT International Search Report and Written Opinion dated Apr. 15, 2008 for PCT/US06/35638.

FLUORESCENT LAMPHOLDER

The present application is a continuation application from a U.S. patent application assigned U.S. patent application Ser. No. 11/520,114 filed on Sep. 12, 2006; the entire contents are incorporated herein by reference.

CROSS-REFERENCE TO RELATED APPLICATION

This application claims the benefit of U.S. Provisional Application No. 60/717,081, filed on Sep. 13, 2005.

FIELD OF THE INVENTION

This invention relates to a fluorescent lampholder, and more particularly to a lampholder for a fluorescent tube of the type comprising an elongate glass envelope having a pair of parallel contact pins at each end.

BACKGROUND OF THE INVENTION

As is well known, conventional fluorescent fixtures comprise an elongate frame which may include an integral reflector. At each end of the frame there is provided a lampholder for receiving the contact pins at the ends of the fluorescent lamp; the lampholder functions to support the lamp and provide electrical power. The lampholder has a top portion with a pair of spaced apart lamp pin contacts to engage the contact pins of the fluorescent lamp and a base portion with a wire opening located on the side surface of the base portion. During installation, wires are inserted through the wire openings of the lampholders and the wires are electrically connected to the lamp pin contacts of the lampholders to provide electrical power to the lamp. One wired lampholder is mounted at one end of a fixture and another lampholder is mounted at the other end of the fixture. A portion of the wires connected to the lampholder assemblies is typically exposed on the exterior surface of the fixture. There is a need for a fluorescent lampholder that connects to wires without exposing the wires to the exterior surface of the fixture.

SUMMARY OF THE INVENTION

In accordance with the present invention, a fluorescent lampholder is provided having a body having an upper portion and a lower portion; the lower portion has a bottom surface with an opening formed therein for receiving a conductor, and the upper portion has an opening for receiving lamp pins of a fluorescent lamp. The lampholder also includes an electrically conductive lamp pin contact positioned within the lower portion so that it electrically connects the received conductor and the received lamp pin. According to one aspect of the invention, the lamp pin contact includes a pair of spaced apart contact members, each of the contact members having a surface with an edge and a notch formed in the edge. Upon placement of the lamp in the lampholder, the lamp pins make contact with the edges of the contact members as they engage with the notches. According to another aspect of the invention, each of the lamp pin contact members has a surface with a notch formed therein, and the lamp pins upon placement of the lamp in the lampholder are parallel to those surfaces.

According to a further aspect of the invention, the body of the lampholder includes a channel formed therein separating the upper portion and the lower portion; the channel is configured to slidably engage a plate of a mounting fixture so that the bottom surface faces an interior of the fixture and the upper portion is exterior to the fixture. The lampholder thus communicates with the interior of the fixture through the opening, thereby providing a path for the conductor from the bottom surface into the interior of the fixture and isolated from the exterior of the fixture.

The lampholder is capable of supporting various types and/or sizes of fluorescent lamps such as "tall", "medium" and "small" T-8 fluorescent lamps as well as other types and/or sizes of fluorescent lamps.

BRIEF DESCRIPTION OF THE DRAWINGS

Other aspects, features, and advantages of the present invention will become more fully apparent from the following detailed description, the appended claims and the accompanying drawings, in which similar elements are given similar reference numerals.

DETAILED DESCRIPTION OF PREFERRED EMBODIMENTS

Figure 1:
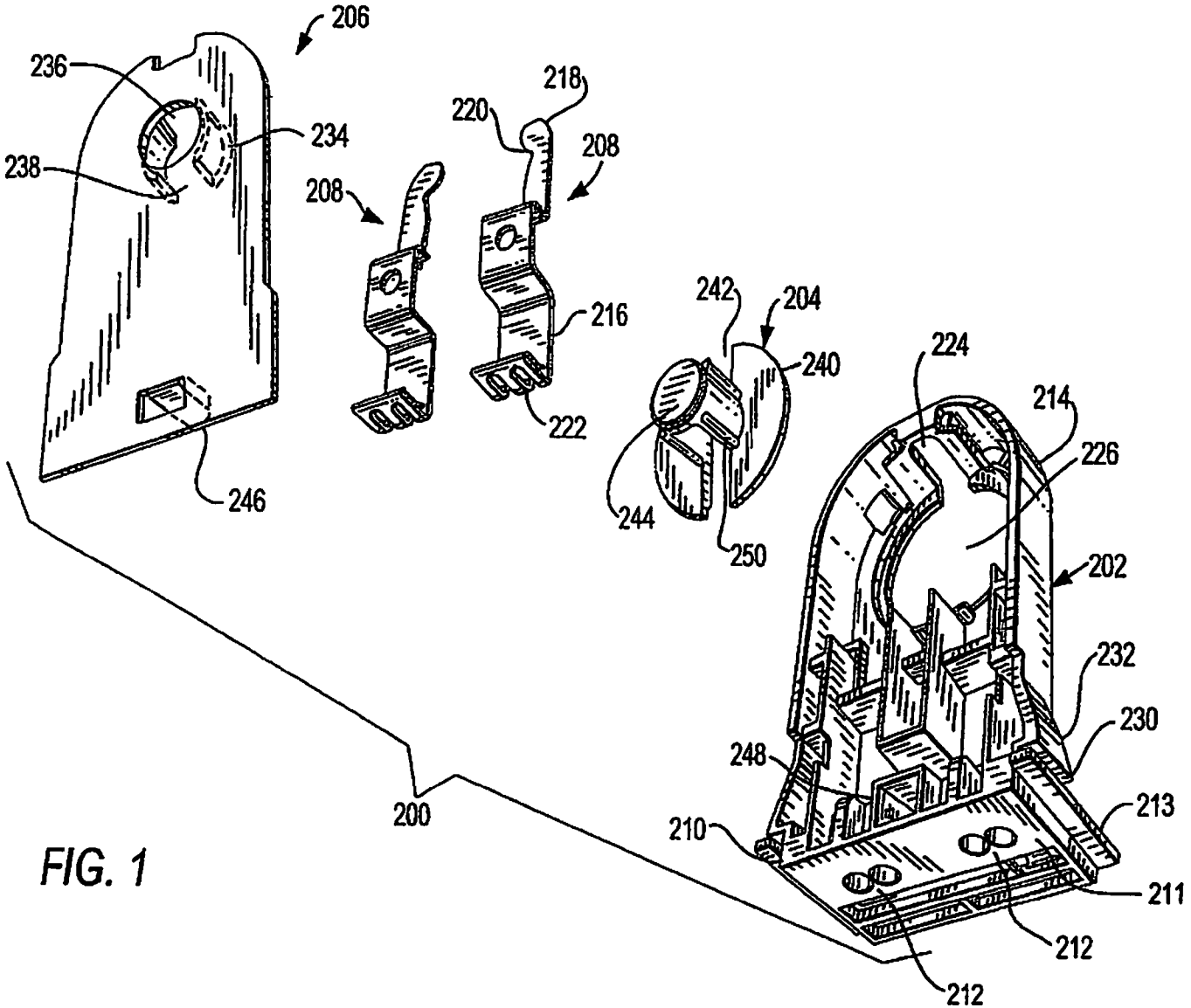
FIG. 1 is an exploded perspective view of a fluorescent lampholder in accordance with an embodiment of the invention.

FIG. 1 shows a fluorescent lampholder 200 according to a first embodiment of the present invention. The lampholder includes a base 202, a rotatable cap 204, a cover 206 and a pair of spaced apart lamp pin contacts 208. The base 202 has a pair of dual wire openings 212 extending through the bottom surface 211 of the bottom portion 210 of the base for receiving a pair of wires from a power source. The base 202 also has a lamp receiving portion 214 located at the top portion of the base for receiving the pins of a fluorescent lamp. The lamp pin contacts 208 each have a wire contact end 216 and a lamp pin contact end 218. Each wire contact end 216 has a pair of spaced apart openings 222 to make electrical contact with the bared end of wires from the power source. As shown in FIG. 1, the wire contact end may be folded on itself to form a clip adjacent the openings, so that the bared end of an insulated wire urged through the opening is held by the clip, thereby electrically connecting the power source and lamp pin contact 208. The openings 222 may also be tapered so as to form a one-way clutch permitting insertion of a bared end of an insulated wire but preventing removal of the wire, while making electrical contact with the bare wire ends. Each lamp pin contact end 218 has a notch 220 formed in an edge thereof, to engage one of the two conductive pins of a fluorescent lamp.

The lamp receiving portion of the base has an entry slot 224 extending from the top exterior of the base to the interior of the base and a circular central opening 226 in the front face. The cover 206 has an interior circular shaped wall 234 aligned with the central opening 226, and a top slot 236 and a bottom slot 238 aligned with the entry slot 224. The cap 204 is formed from a circular shaped disc 240 sized to fit and align with the central opening 226. A slot 242 extends through the disc for receiving the pins of a fluorescent lamp. The cap 204 has a centrally located pin 244 on the interior surface of the disc; pin 244 is sized to rotatably fit within the circular shaped wall 234. Ribs 250 located around the pin are used to deflect the lamp pin contacts 208 when the cap 204 is rotated during installation of a fluorescent lamp.

Figure 3:
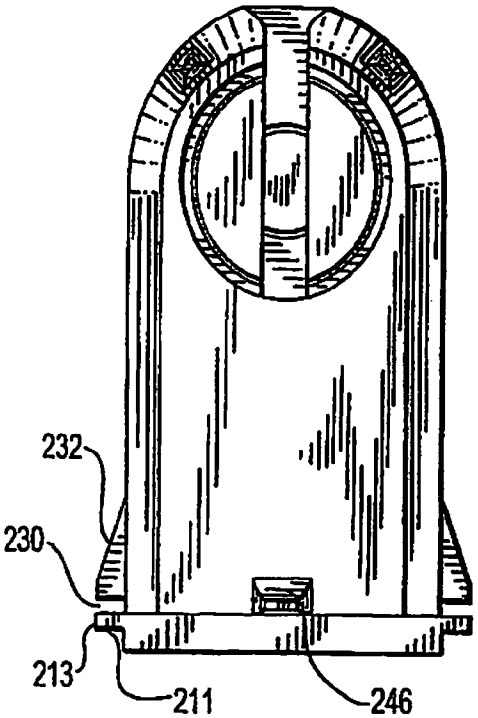
FIGS. 2, 3 and 4 are assembled side, front and bottom views respectively of the fluorescent lampholder of FIG. 1.
Figure 4:
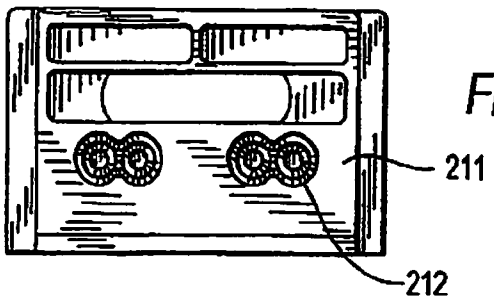
Figure 2:
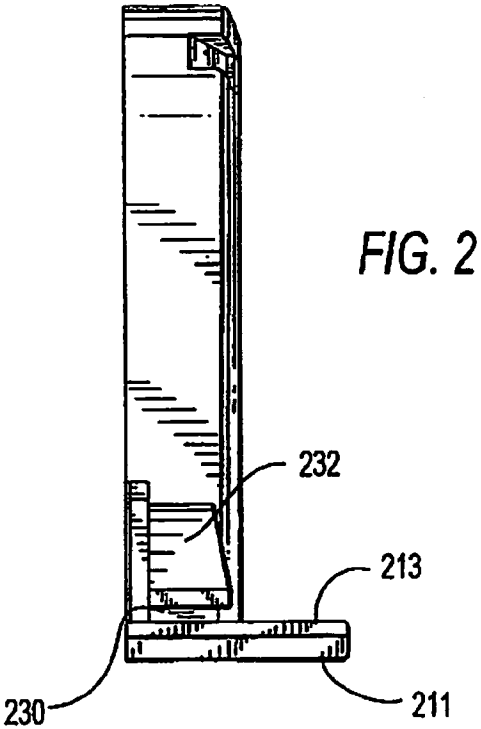

The lamp pin contacts 208 are mounted to the interior surface of the cover 206, with the wire contact end 216 oriented toward the base bottom portion 210 and the pin contact end 218 oriented toward the lamp receiving portion 214. The cover 206 covers the back of the base 202 and is held in place using tabs 246 which mate with corresponding notches 248 in the base. A pair of channels 230 for mounting the base 202 to a fixture are formed on each side of the base 202, between the top surface 213 of the bottom portion 210 and tabs 232. The lampholder may be mounted by sliding the lampholder into a cutout portion of a plate so that the edges of the cutout fit into channels 230; the edges are covered by tabs 232 (see FIGS. 2 and 3). Bottom surface 211, including wire openings 212, is thus on the underside of the plate (see FIG. 4). Accordingly, wires connected to the lampholder are not visible from the top side of the plate.

The base 202, cap 204 and cover 206 are fabricated from insulating materials such as thermosetting or thermoplastic materials, Bakelite or the like. The lamp pin contacts 208 are fabricated from electrically conducting material such as copper, brass, or the like, or a combination thereof.

To make electrical connection between the lampholder 200 and a power source, the bared end of a wire is inserted into one of the dual openings 212 in the bottom surface 211 of the bottom portion of the base, and then urged into the corresponding opening 222 of lamp pin contact 208 (see FIG. 5) until pin contact 208 makes electrical contact with and grips the bared end of the wire. It should be noted that a second wire can be connected to the other of the dual openings 222 depending on the application. For example, both of the dual openings 222 of a contact 208 would be used in a daisy-chain wiring of multiple lampholders. The power source may include standard fluorescent lamp power components such as a ballast and a starter, as is understood by those skilled in the art.

Figure 5:
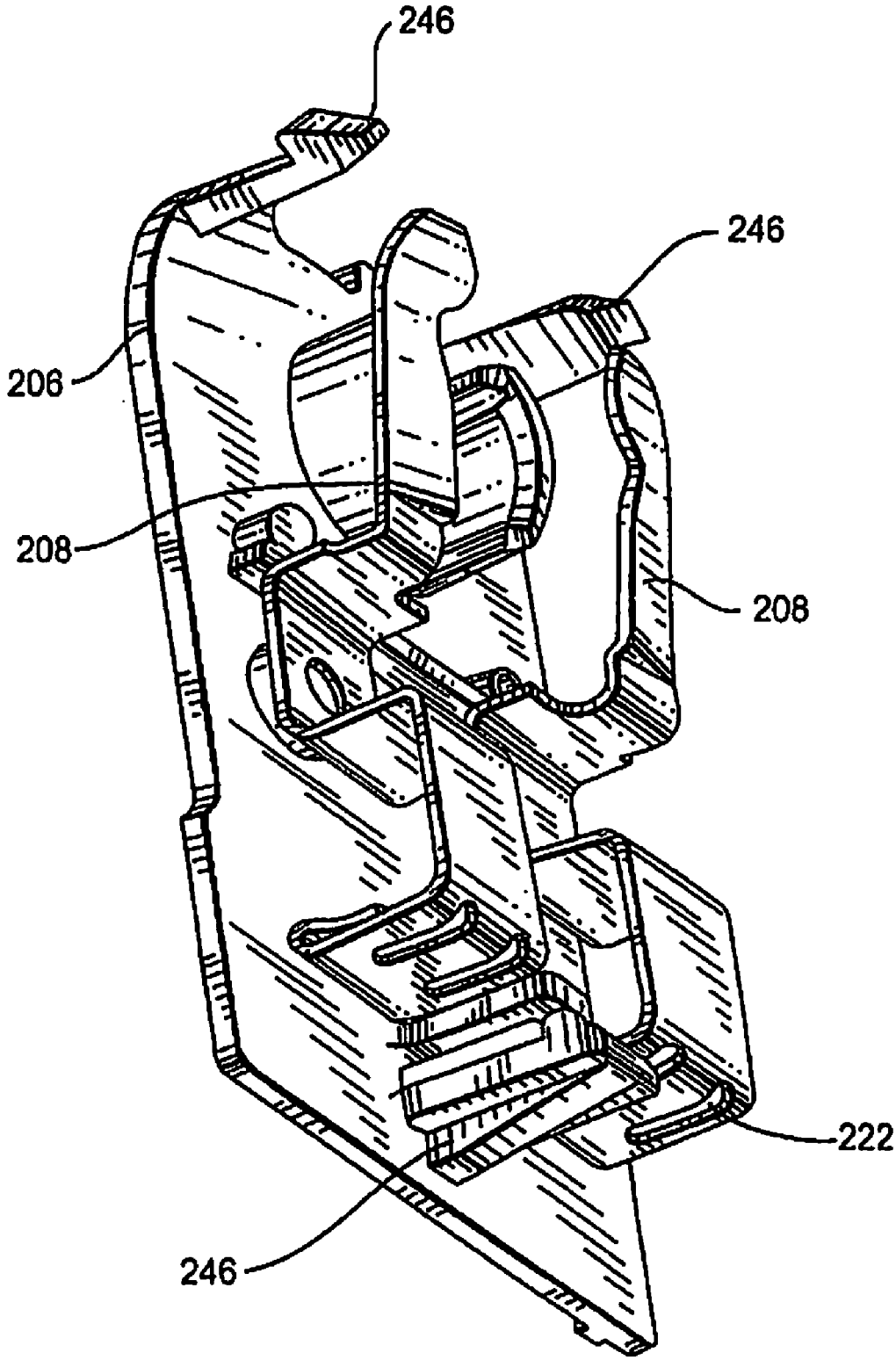
FIG. 5 is a partially assembled perspective view of the fluorescent lampholder of FIG. 1, showing the cover and lamp pin contacts.
Figure 6:
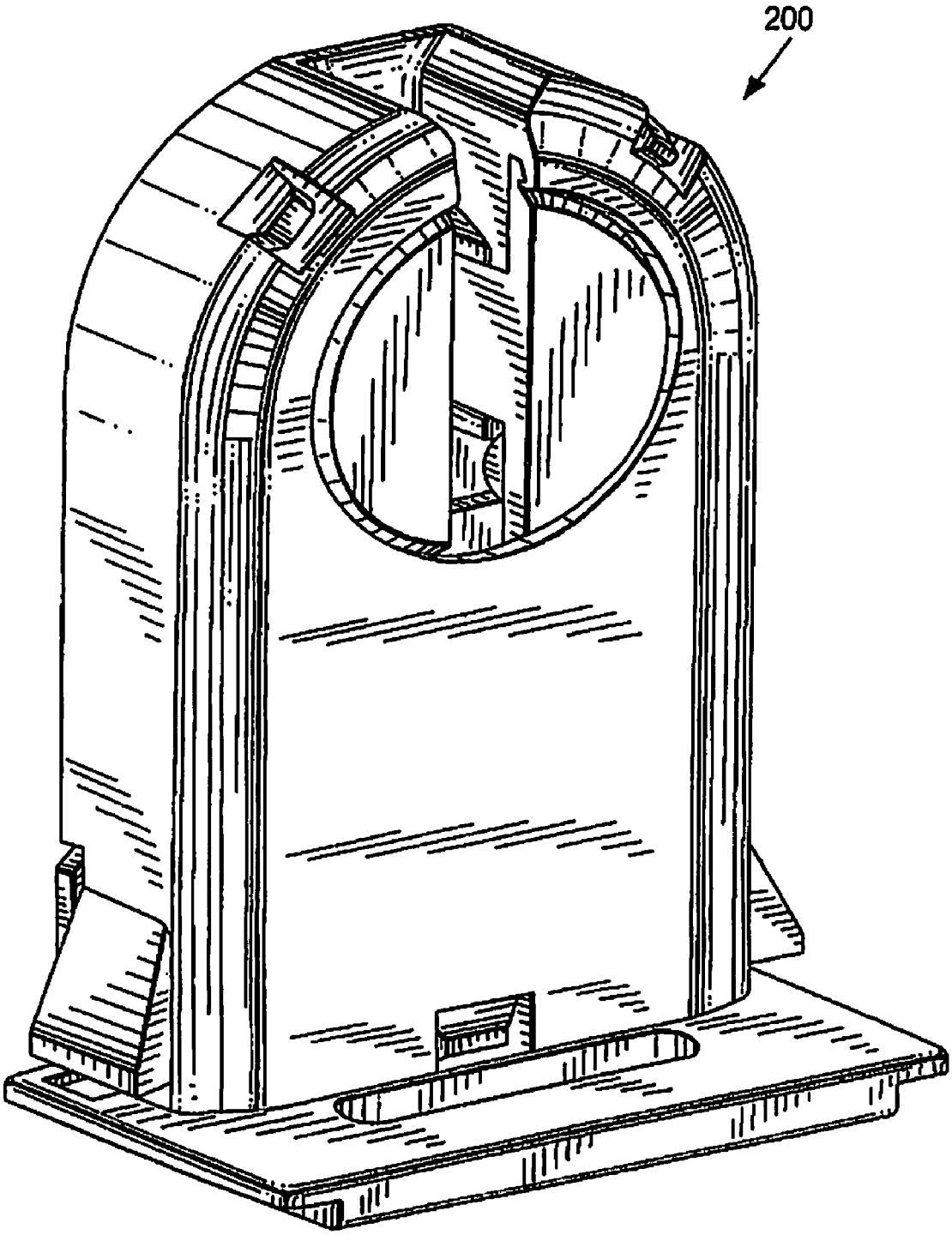
FIG. 6 is an assembled perspective front view of the fluorescent lampholder of FIG. 1.

FIG. 5 also shows details of the tabs 246 used to secure the cover 206 to the base 202. In this embodiment, there are three tabs formed integrally with the cover, two near the top end of the cover and one near the bottom end. FIG. 6 shows the assembled lampholder 200 with the slot 242 in cap 204 aligned with slot 224, so as to receive the pins of a fluorescent lamp.

Figure 7A:
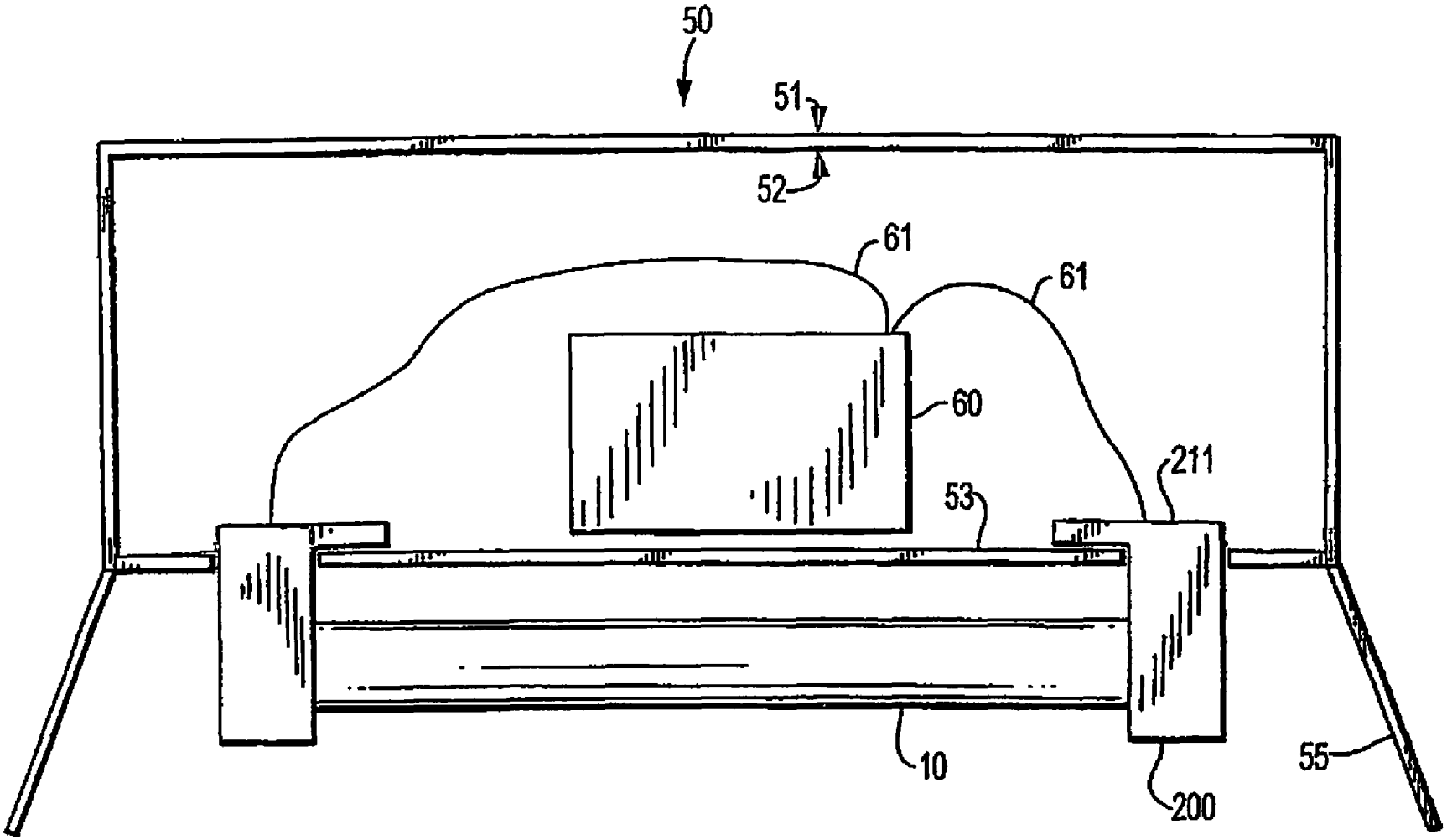
FIG. 7A is a schematic illustration of an installation of a fluorescent lamp and lampholder in a fixture, according to an embodiment of the invention.

Once the lampholder 200 has been wired, the wired lampholder is mounted to a fixture 50 such as a housing, at the ends of a reflector 55 or other similar mounting (see FIG. 7A). In one embodiment, the lampholder 200 is mounted to a housing made of relatively thin metal plates having an exterior surface 51 and an interior surface 52. The wired lampholder 200 is slidably mounted onto an opening at an end of a plate 53 so that the plate rests in mounting channels 230. A second lampholder is mounted at the other end of the fixture in a similar manner. A power supply 60 is located inside the housing, with wires 61 connecting to the lampholders. In this and other embodiments described below, the bottom surface 211 of the base faces the interior of fixture 50, and the openings 212 in the bottom surface communicate with the interior of the fixture. Accordingly, the lampholders provide a wiring connection path such that the wires extend from the bottom surface 211 of the base into the interior, preventing the wires from being exposed to the exterior surface of the housing. The lampholders are thus mounted to the exterior of fixture 50 while the wires 61 are hidden within the interior. This offers a number of advantages, including an improved electrical wiring connection, a more pleasing appearance and a reduction in the cost of manufacture.

Figure 7B:
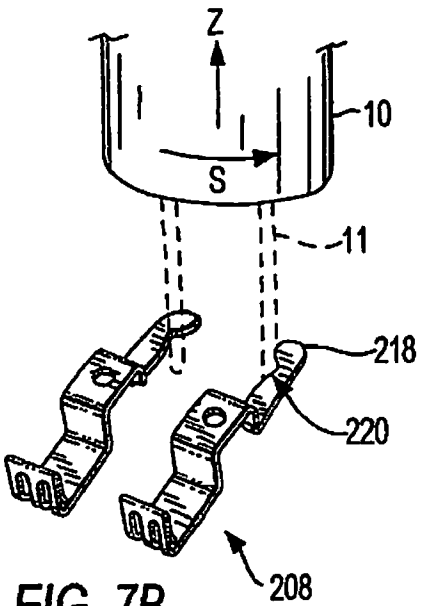
FIG. 7B is a detail illustration of rotation of a fluorescent lamp to engage electrical contacts of a lampholder, in accordance with an embodiment of the invention.
Figure 11:
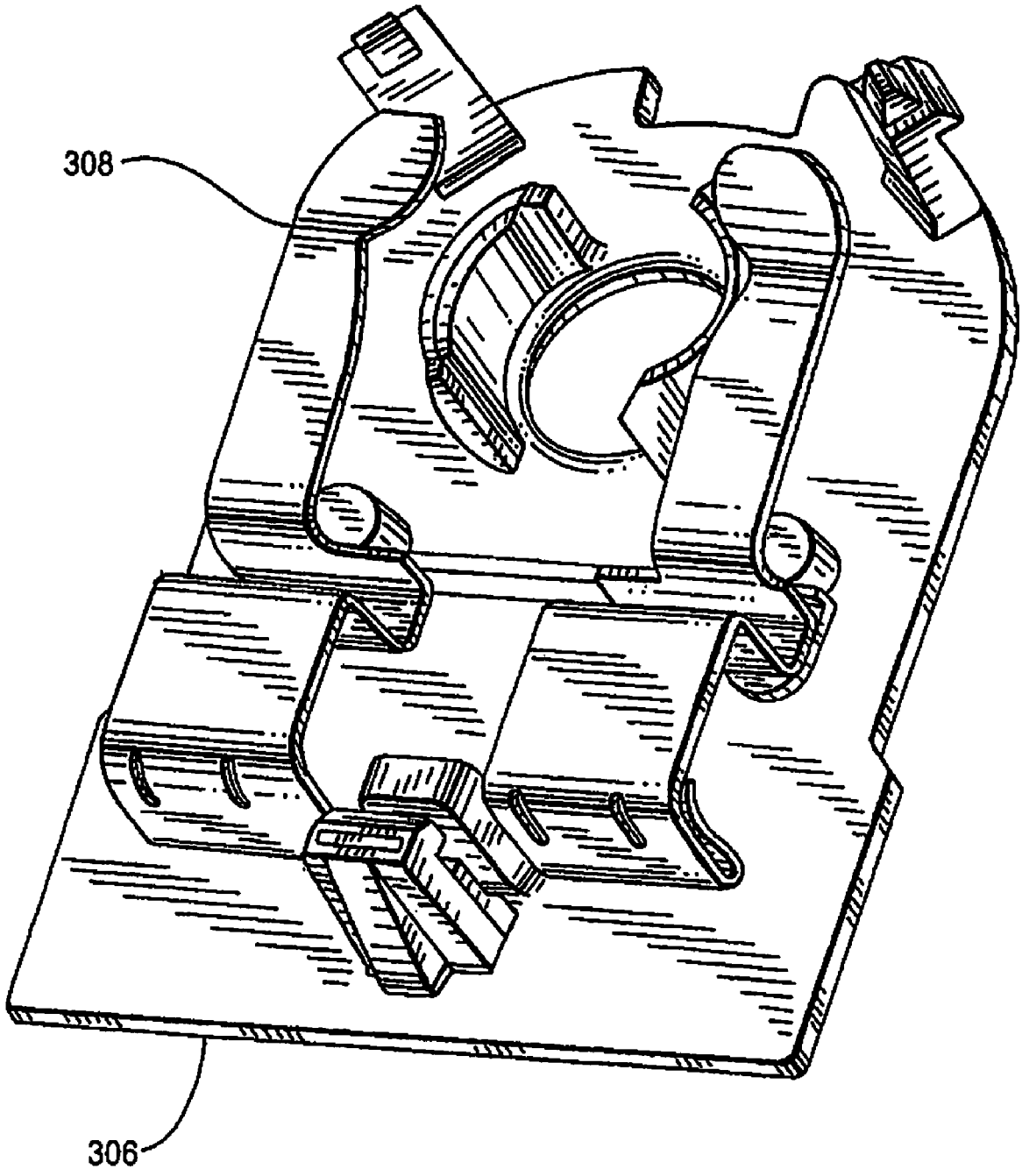
FIG. 11 is a partially assembled perspective view of a fluorescent lampholder according to still another embodiment of the invention, showing a cover and lamp pin contacts thereof.
Figure 12:
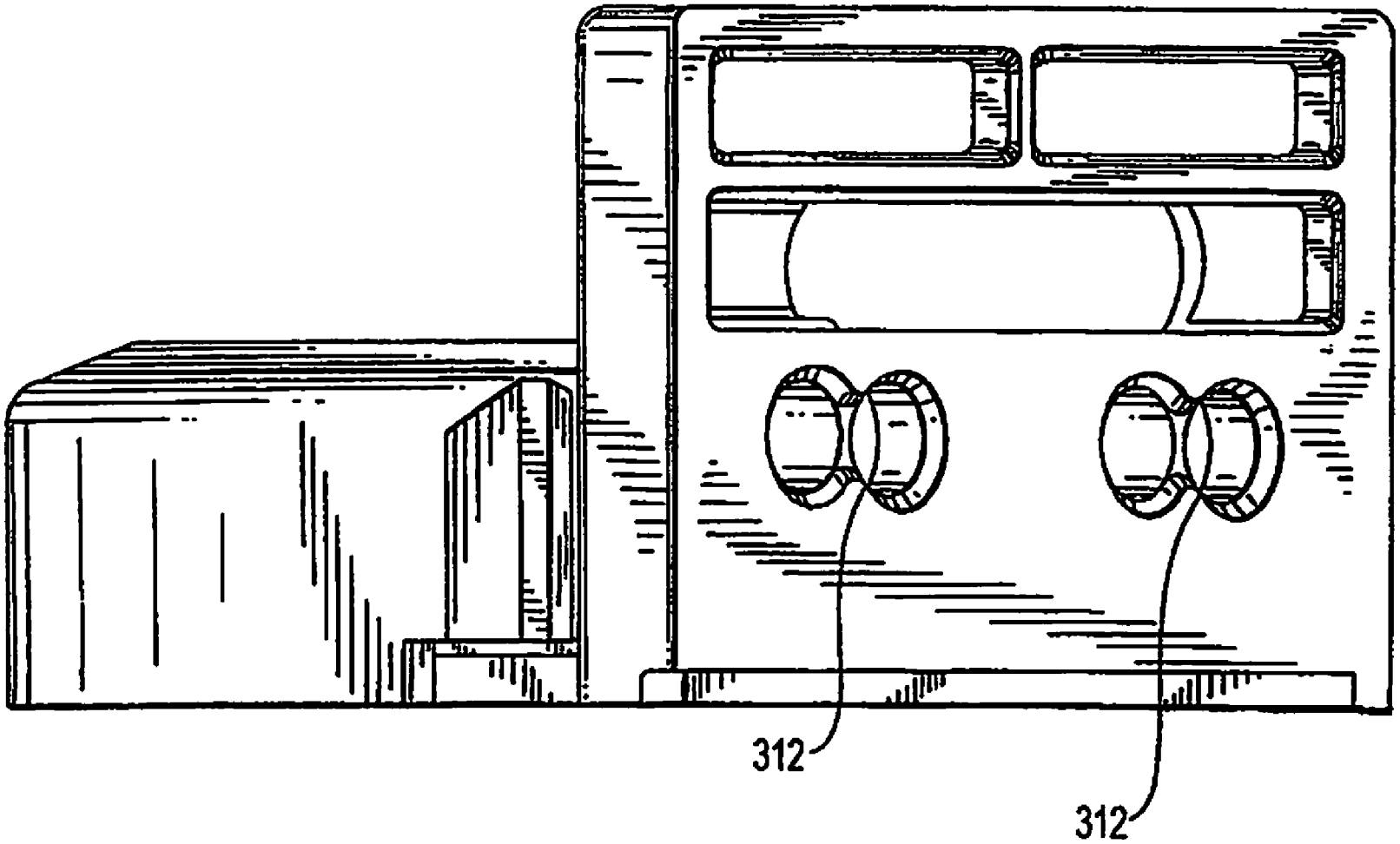
FIG. 12 is an assembled perspective view of a bottom portion of the lampholder of FIG. 11.
Figure 14:
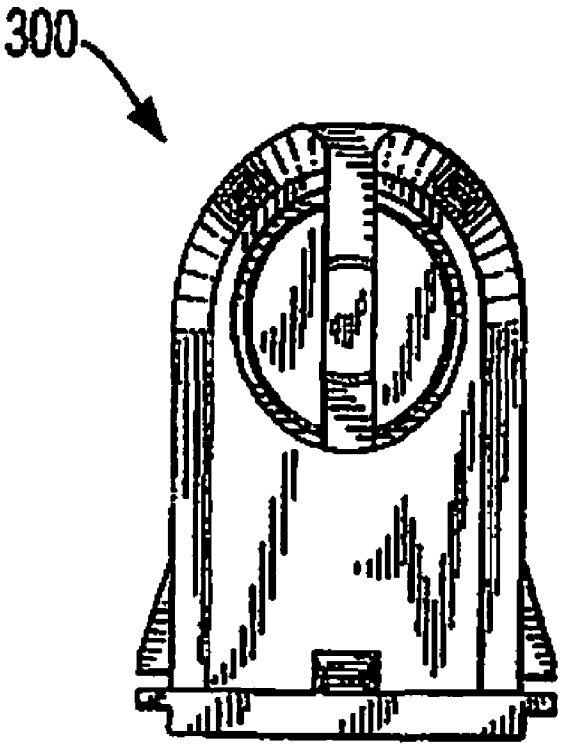
FIGS. 13 and 14 are assembled side and front views, respectively, of the lampholder of FIGS. 11 and 12.
Figure 13:
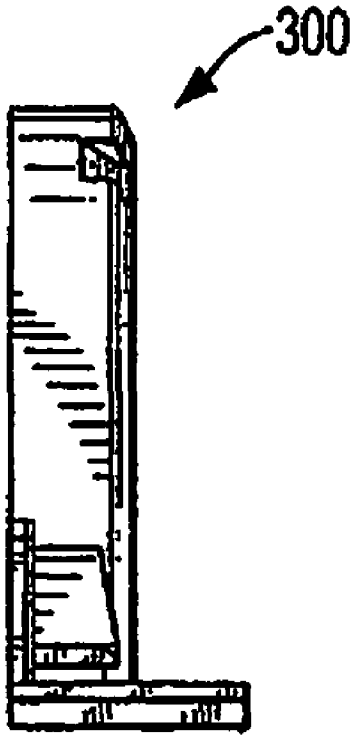

Once the lampholders are mounted to the fixture, a fluorescent lamp 10 is attached to the lampholders as described below. The fluorescent lamp is turned so that its pins at one end are positioned one above the other; the lamp pins are made to enter a channel formed by slot 224 of the base and slot 242 of the cap (as shown in FIG. 6). Once the lamp pins are aligned in the channel, the lamp is rotated until each of the lamp pins enters notch 220 of its associated lamp pin contact 208. The tapered lead-ins to each of the notches from above and below assure that the lamp pins enter the notches. The resilience and shape of the pin contact end allows it to first be deflected as the lamp pins move into position in the notches 220, and then return to grip the lamp pins once they are seated in their associated notches 220. It is noteworthy that lamp pin contact ends 218 are flat, with notches 220 formed in the inside edges thereof (see FIGS. 1 and 5). Referring to FIG. 7B, when the lamp 10 is rotated in a direction S to engage pins 11 in the notches 220, the axis of rotation Z of the lamp is normal to the flat surfaces of contact ends 218. A lamp pin being moved against contact 208 thus slides along the edge of the contact until it engages with notch 220. This is sometimes referred to as an "edge wipe" contact between the lamp pin and the lampholder.

Figure 9:
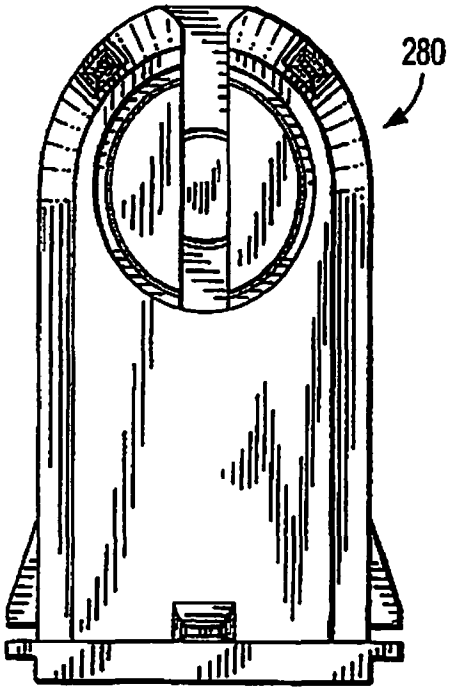
FIGS. 8, 9 and 10 are assembled side, front and bottom views respectively of a fluorescent lampholder having a single set of wire openings, in accordance with another embodiment of the invention.
Figure 10:
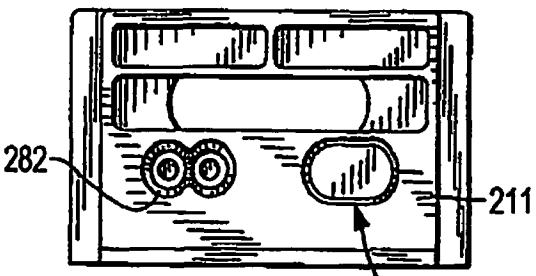
Figure 8:
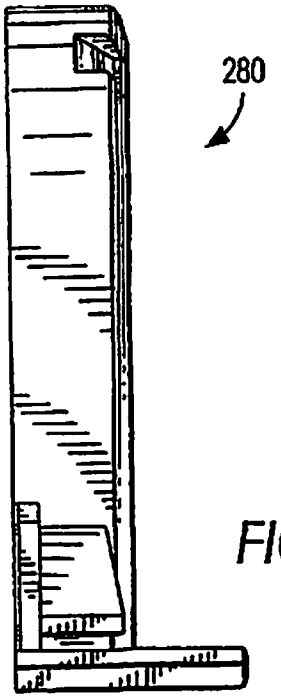

FIGS. 8-10 show a fluorescent lampholder 280 in accordance with another embodiment. The lampholder 280 is similar to the lampholder 200 except that the lampholder 280 has only one set of wire openings 282, whereas lampholder 200 has a pair of dual wire openings 212. The lampholder 280 is for use with a fluorescent lamp that has two pins for mechanical support, but where only one pin is necessary to deliver power to the lamp. To accommodate such a lamp, a shunt (not shown) is placed across the lamp pin contacts to electrically couple the contacts together, thereby effectively providing power from a single contact. Since only one contact is required, only a single set of wire openings is needed; the other set of wire openings is closed by a cover 283, as shown in FIG. 10.

Figure 16:
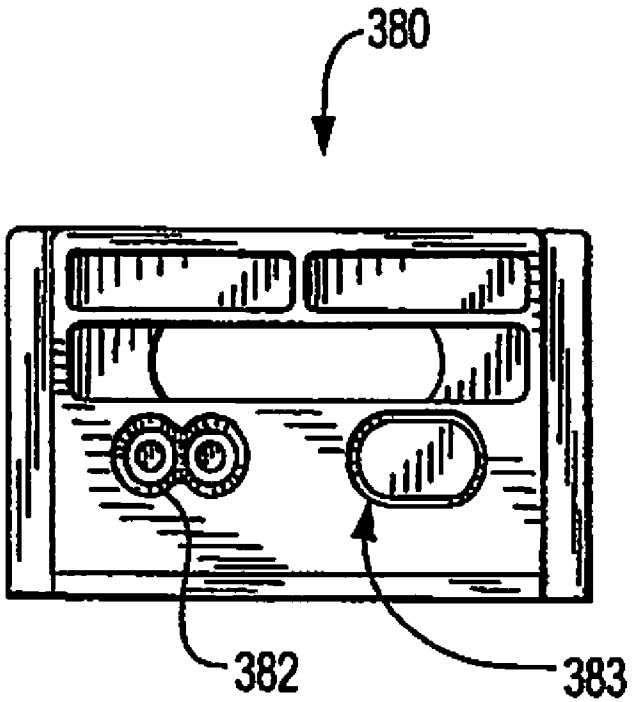
FIG. 16 is an assembled bottom view of a lampholder having only a single set of wire openings, in accordance with a further embodiment of the invention.
Figure 15:
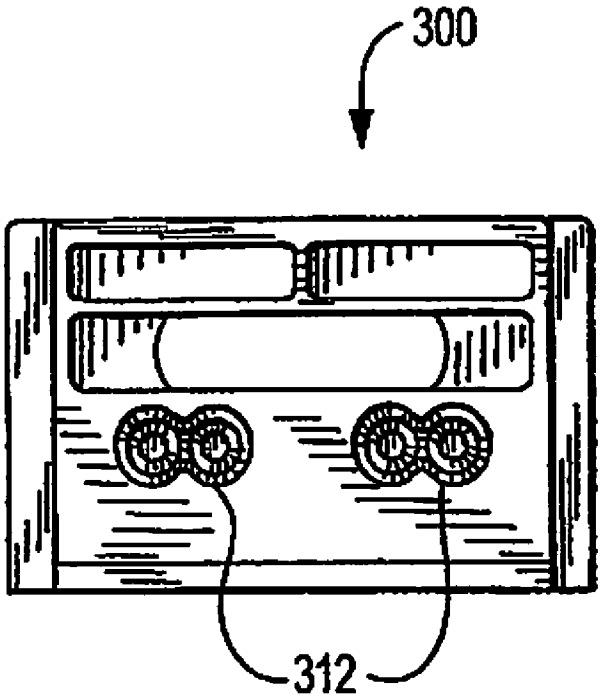
FIG. 15 is an assembled bottom view of the lampholder of FIGS. 11-14.

FIGS. 11-15 show a fluorescent lampholder 300 in accordance with still another embodiment of the invention. Lampholder 300 is similar in construction and operation to lampholder 200 except that the lampholder 300 is sized to support a smaller fluorescent lamp (compare FIGS. 13 and 14 with FIGS. 2 and 3 respectively). Lampholder 300 includes lamp pin contacts 308 and has dual wire openings 312 for making wiring connections to the lamp pin contacts (see FIGS. 11 and 12). As described above with reference to the first embodiment, lampholder 300 has two pairs of dual wire openings 312. In a further embodiment, lampholder 380 is similar to lampholder 300 except that the lampholder 380 has only one set of wire openings 382. Lampholder 380 is for use with a fluorescent lamp that has two pins for mechanical support, but where only one pin is necessary to deliver power to the lamp. To accommodate such a lamp, a shunt (not shown) is placed across the lamp pin contacts to electrically couple the contacts together, thereby effectively providing power from a single contact. Since only one contact is required, only a single set of wire openings is needed; the other set of wire openings is closed by a cover 383, as shown in FIG. 16.

Figure 17:
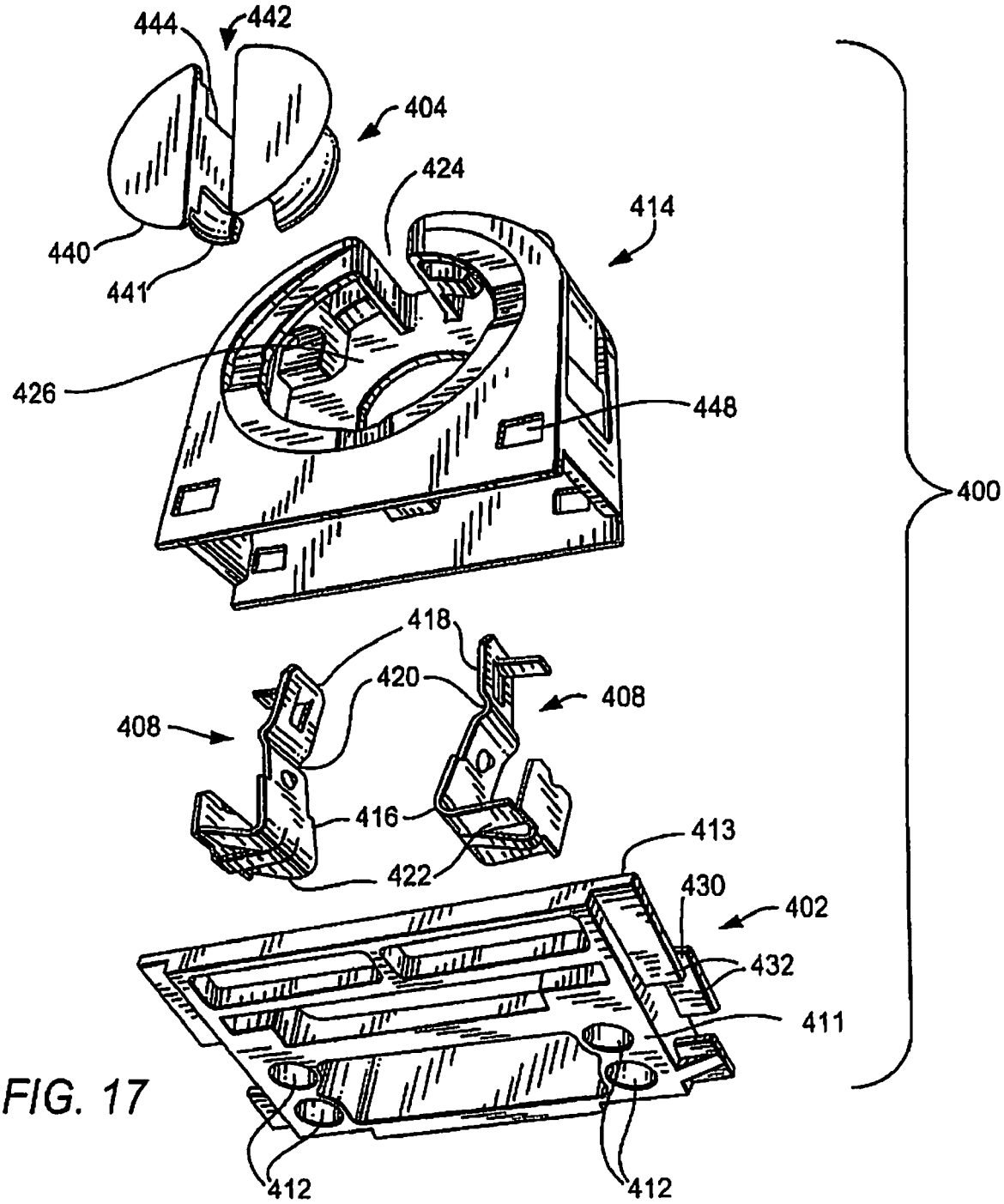
FIG. 17 is an exploded perspective view of a fluorescent lampholder in accordance with still another embodiment of the invention.

FIG. 17 is an exploded perspective view of a fluorescent lampholder 400 in accordance with still another embodiment of the invention. Lampholder 400 includes a base 402, a rotatable cap 404, a lamp receiving portion 414 and a pair of spaced apart lamp pin contacts 408. The base 402 has a pair of dual wire openings 412 extending through the bottom surface 411 for receiving a pair of wires from a power source, and a top surface 413 for supporting the contacts 408. A pair of channels 430 for mounting to a fixture are formed on each side of the base 402 located between the top surface 413 of the base and flat, rectangular shaped tabs 432. Unlike the angled tabs 232 of the lampholder 200 (compare FIG. 3), the flat tabs 432 of lampholder 400 reduce the need for additional "camming" during the molding process of manufacture.

The lamp pin contacts 408 each have a wire contact end 416 with a pair of tapered openings 422 to make electrical contact with the bared end of wires from a power source, and a pin contact end 418 with a notch 420 to engage one of the two conductive pins of a fluorescent lamp. The tapered openings 422 function as a one-way clutch that allows the bared end of an insulated wire to be inserted but prevents the removal of the wire while making electrical contact with the bare wire ends. Unlike the lampholder 200 described above, in which the lamp pins of a lamp make contact with the edge of the lamp pin contacts 208, contacts 408 make contact with the lamp pins at notches 420 located on the front surface of the contacts. A fluorescent lamp placed in lampholder 400 therefore has the lamp pins thereof parallel to the front surfaces of the contacts, with the pins resting in the notches 420.

Figure 19:
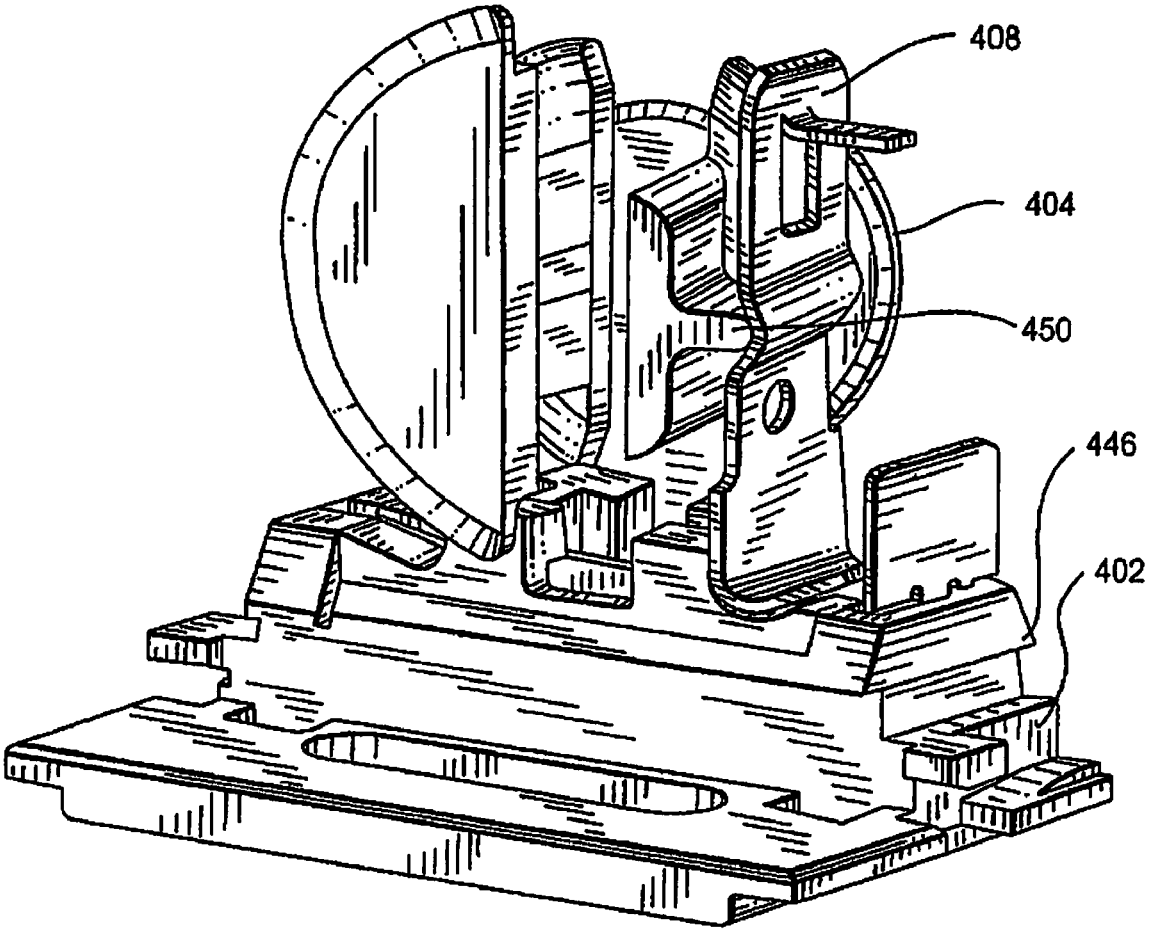
FIG. 19 is a cutaway view of the interior of the fluorescent lampholder of FIG. 17.
Figure 20:
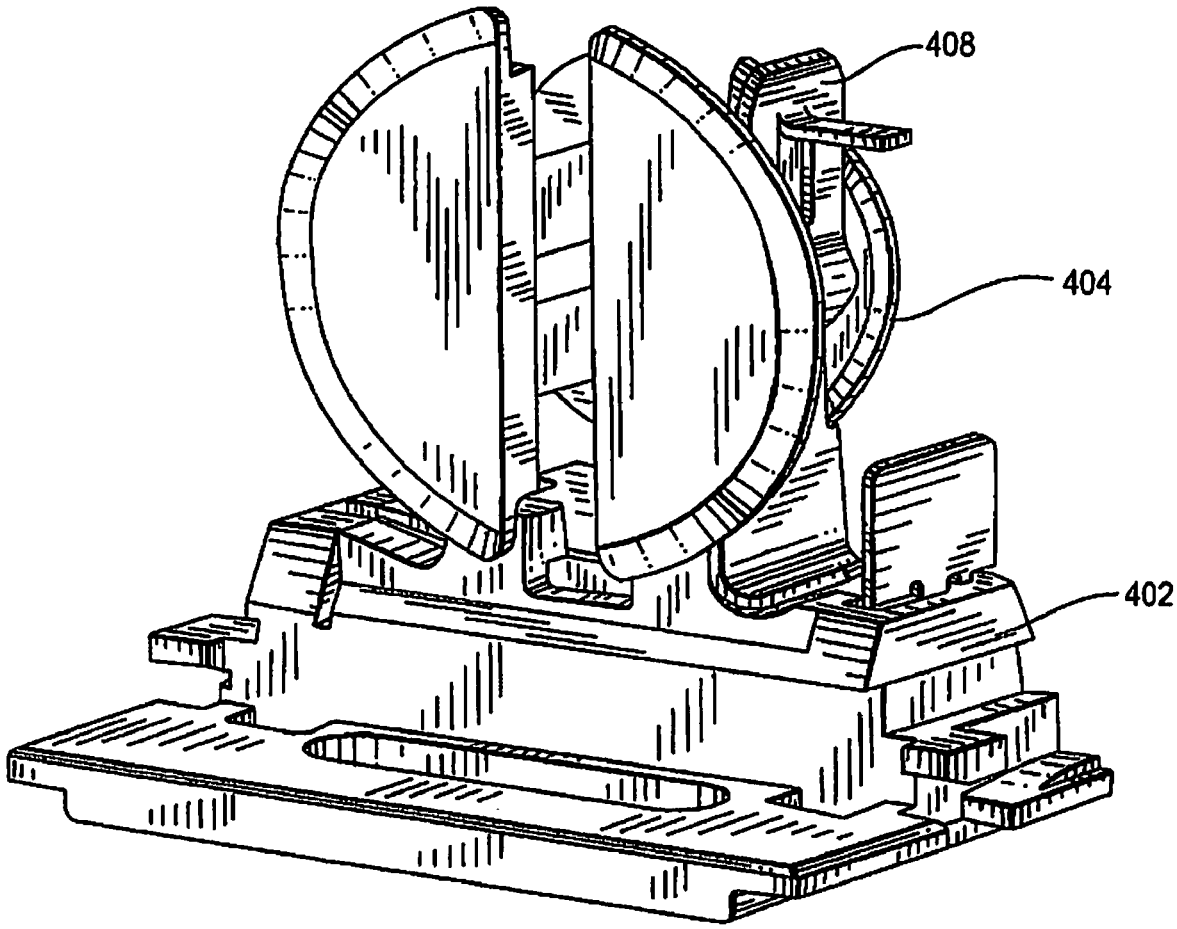
FIG. 20 is a partially assembled perspective view of the fluorescent lampholder of FIG. 17.

The lamp receiving portion 414 has an entry slot 424 extending from the top exterior of the lamp receiving portion to the interior thereof and a circular central opening 426 in the front face. The cap 404 is formed from two spaced apart circular shaped discs 440, 441 with a centrally located pin portion 444 connecting the discs. The discs are sized so that cap 404 fits rotatably within the circular opening 426. The cap 404 has a slot 442 extending through the exterior surface of the exterior disc; the cap is rotated so that this slot and the slot is capable of being aligned with the slot 424 of the cover to receive the pins of a fluorescent lamp. Protrusions 450 extending from the side of the pin portion 444 are adapted to make contact with notches 420 on the lamp pin contacts 408, and deflect the lamp pin contacts 408 when the cap 404 is rotated during the installation of a fluorescent lamp (see FIG. 19).

Figure 18:
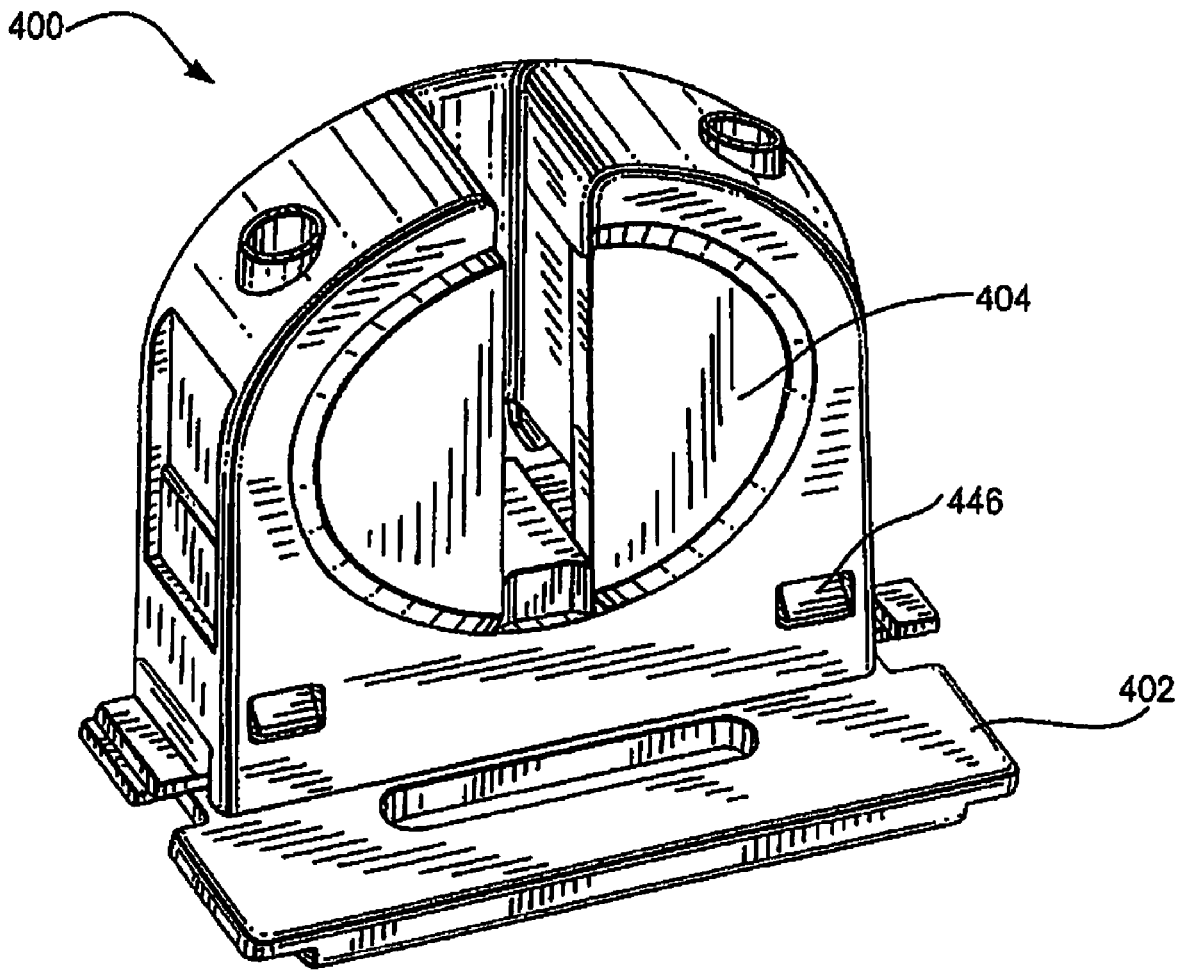
FIG. 18 is an assembled front perspective view of the fluorescent lampholder of FIG. 17.
Figure 21:
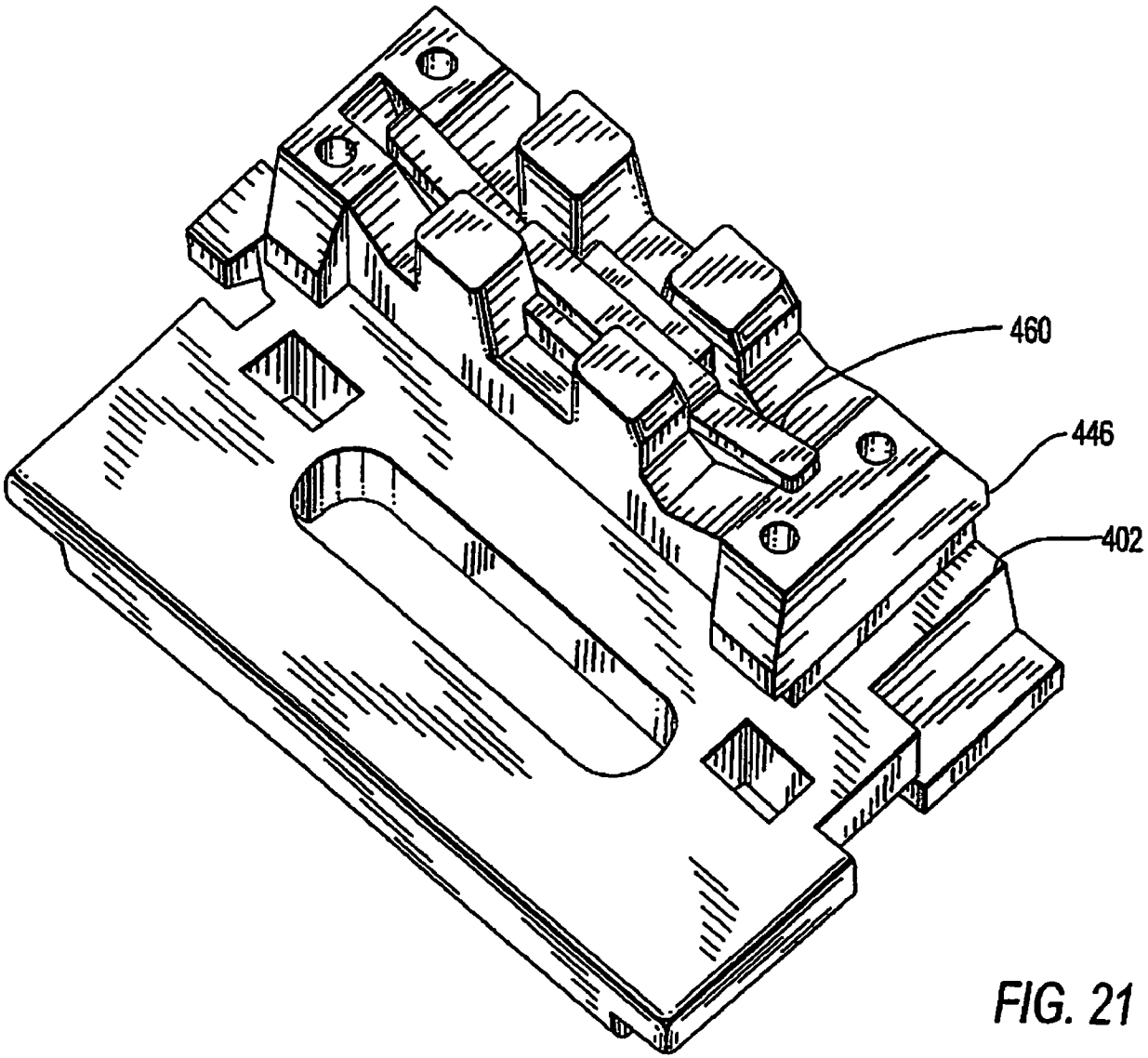
FIG. 21 is a detailed view of the base of the lampholder of FIG. 17.

The wire contact end 416 of each lamp pin contact 408 is mounted onto the top portion of the base for receiving wires, and the pin contact end 418 extends into the interior of lamp receiving portion 414 for receiving the pins of a fluorescent lamp. Lamp receiving portion 414 is secured to base 402 and is held in place by tabs 446 on the base which mate with corresponding notches 448 in the lamp receiving portion (see FIGS. 18 and 19). A shunt 460 is mounted onto the base to electrically connect the two pins 408 together (see FIG. 21).

The lampholder 400 components are fabricated from materials similar to the lampholder 200 above. Lampholder 400 is likewise wired and mounted as described above with reference to lampholder 200.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A fluorescent lampholder, comprising:

a body member having a top portion and a bottom portion;

at least two lamp pin contact members, each of the lamp pin contact members having a first end, a second end, and a third end, the third end connecting the first end to the second end; and a rotatable cap having a centrally located hub;

wherein the first end of each of the lamp pin contact members includes one or more notches, the second end of each of the lamp pin contact members includes one or more equally spaced openings, and the third end of each of the lamp pin contact members is a U-shaped portion including an opening; and wherein the first end of each of the lamp pin contact members is configured to be slidably coupled to the body member.

2. The fluorescent lampholder of claim 1, wherein said centrally located hub further comprises one or more ribs equally spaced around a circumference of the hub.

3. The fluorescent lampholder of claim 1, wherein the rotatable cap is rotated during installation of a lamp.

4. The fluorescent lampholder of claim 1, wherein the one or more notches of the first end of each of the lamp pin contact members are located opposite each other.

5. The fluorescent lampholder of claim 1, wherein the opening of the U-shaped portion is a centrally located circular opening.

6. The fluorescent lampholder of claim 1, wherein the fluorescent lampholder is slidably mounted on a mounting plate.

7. The fluorescent lampholder of claim 1, wherein the bottom portion is configured to receive one or more conductors from a power source via a set of wire openings, where the set of wire openings prevent wire exposure.

8. The fluorescent lampholder of claim 1, wherein the bottom portion is configured to receive one or more conductors from a power source via two sets of wire openings, where the two sets of wire openings prevent wire exposure.

9. The fluorescent lampholder of claim 1, wherein pins of a lamp contact and slide along inner edges of the contact members when inserted therein and rotated.

10. The fluorescent lampholder of claim 1, wherein the second end of each of the lamp pin contact members is configured to receive one or more conductors from a bottom surface of the bottom portion of the body member.

11. The fluorescent lampholder of claim 1, wherein the at least two lamp pin contact members are configured for enabling pins of a lamp inserted within the body member to contact and slide along inner edges of the at least two lamp pin contact members when the lamp is rotated.

12. The fluorescent lampholder of claim 1, wherein the second end of each of the at least two lamp pin contact members comprises a first bend and a second bend.

13. The fluorescent lampholder of claim 12, wherein the second bend is substantially coplanar with at least a portion of the third end.

14. The fluorescent lampholder of claim 12, wherein the first bend is about 90 degrees.

15. The fluorescent lampholder of claim 12, wherein the second bend is less than 20 degrees.

16. The fluorescent lampholder of claim 1, wherein at least a portion of the first end is substantially coplanar with at least a portion of the second end.

17. A fluorescent lampholder, comprising:

a body member having a top portion and a bottom portion;

at least two lamp pin contact members, each of the lamp pin contact members having a first end, a second end, and a third end, the third end connecting the first end to the second end;

wherein the first end of each of the lamp pin contact members includes one or more notches, the second end of each of the lamp pin contact members includes one or more equally spaced openings, and the third end of each of the lamp pin contact members is a U-shaped portion including an opening, where a main axis is normal to the first end, second end, and third end of the lamp pin contact members;

wherein the second end of each of the lamp pin contact members is configured to receive, substantially along a longitudinal axis, one or more conductors from the bottom surface of the bottom portion of the body member where the longitudinal axis is parallel to the main axis of the contact members; and wherein a rotatable cap is rotated during installation of a lamp.

18. The fluorescent lampholder of claim 17, further comprising said rotatable cap having a centrally located hub.

19. The fluorescent lampholder of claim 17, wherein said centrally located hub further comprises one or more ribs equally spaced around a circumference of the hub.

20. The fluorescent lampholder of claim 17, wherein the one or more notches of the first end of each of the lamp pin contact members are located opposite each other.

21. The fluorescent lampholder of claim 17, wherein the opening of the U-shaped portion is a centrally located circular opening.

22. The fluorescent lampholder of claim 17, wherein the fluorescent lampholder is slidably mounted on a mounting plate.

23. The fluorescent lampholder of claim 17, wherein the bottom portion is configured to receive the one or more conductors from a power source via a set of wire openings, where the set of wire openings prevent wire exposure.

24. The fluorescent lampholder of claim 17, wherein the bottom portion is configured to receive the one or more conductors from a power source via two sets of wire openings, where the two sets of wire openings prevent wire exposure.

25. The fluorescent lampholder of claim 17, wherein pins of the lamp contact and slide along inner edges of the contact members when inserted therein and rotated.

26. The fluorescent lampholder of claim 17, wherein the at least two lamp pin contact members are configured for enabling pins of a lamp inserted within the body member to contact and slide along inner edges of the at least two lamp pin contact members when the lamp is rotated.

27. The fluorescent lampholder of claim 17, wherein the second end of each of the at least two lamp pin contact members comprises a first bend and a second bend.

28. The fluorescent lampholder of claim 27, wherein the second bend is substantially coplanar with at least a portion of the third end.

29. The fluorescent lampholder of claim 27, wherein the first bend is about 90 degrees.

30. The fluorescent lampholder of claim 27, wherein the second bend is less than 20 degrees.

31. The fluorescent lampholder of claim 17, wherein at least a portion of the first end is substantially coplanar with at least a portion of the second end.

* * * * *